US008413687B1

(12) United States Patent
Woodring

(10) Patent No.: US 8,413,687 B1
(45) Date of Patent: Apr. 9, 2013

(54) INSULATED SEWER VENT COVER

(76) Inventor: David W. Woodring, Raymond, SD (US)

( * ) Notice: Subject to any disclaimer, the term of this patent is extended or adjusted under 35 U.S.C. 154(b) by 97 days.

(21) Appl. No.: 13/069,448

(22) Filed: Mar. 23, 2011

(51) Int. Cl.
*F16L 53/00* (2006.01)
*E04D 13/14* (2006.01)

(52) U.S. Cl.
USPC ..... 138/27; 138/89; 52/219; 52/199; 52/58; 285/42

(58) Field of Classification Search ..... 138/27, 138/148, 149; 52/302.1, 302.6, 302.7, 199, 52/58
See application file for complete search history.

(56) References Cited

U.S. PATENT DOCUMENTS 1,923,220 A * 8/1933 Lightbown ..... 285/13
2,613,166 A 10/1952 Gronemeyer
3,436,880 A 4/1969 Kifer
3,797,181 A 3/1974 Nievelt
4,115,961 A 9/1978 Bishop
4,442,643 A 4/1984 Stadheim
5,245,804 A 9/1993 Schiedegger et al.
5,694,724 A 12/1997 Santiago
5,979,505 A * 11/1999 Drechsel ..... 138/32
6,185,885 B1 * 2/2001 Thaler ..... 52/219
6,244,006 B1 6/2001 Shue et al.
2008/0271391 A1 * 11/2008 Dalmasso ..... 52/199

* cited by examiner

*Primary Examiner* — Patrick F Brinson
(74) *Attorney, Agent, or Firm* — Montgomery Patent & Design, LLC; Robert C. Montgomery

(57) ABSTRACT

An insulated sewer vent cover designed to passively prevent ice blockage, comprises a sealed annular insulating space comprising either entrapped air or an appropriate insulation material. The vent cover further comprises a plurality of concentrically arranged and chemically bonded plastic plumbing components which include a pair of bushings, a pair of couplers, and a pair of tubing sections of different diameters. These components are designed to be installed and chemically bonded onto an existing roof-mounted sewer vent pipe.

16 Claims, 2 Drawing Sheets

INSULATED SEWER VENT COVER

RELATED APPLICATIONS

The present invention was first described in a notarized Official Record of Invention on Jan. 20, 2010, that is on file at the offices of Montgomery Patent and Design, LLC, the entire disclosures of which are incorporated herein by reference.

FIELD OF THE INVENTION

The present invention relates generally to ventilation pipes for sewer systems, and in particular, to a selectively customizable insulating cover for a sewer vent pipe.

BACKGROUND OF THE INVENTION

A common problem experienced in sub-freezing temperatures is the freezing over of a roof-located ventilation pipe of a sanitary waste system. The warm air that rises out of such stacks generally contains a significant amount of water vapor. When the vapor passes by the cold, exposed portion of the roof vent, it condenses onto the interior surfaces of the roof vent at a rapid rate and subsequently freezes. If this condensation and freezing cycle continues for a sufficiently long period, total blockage of the vent line can occur.

Unblocking the vent line generally requires a dangerous trip to the roof, which in such weather is often covered with snow and ice just. The actual removal of the ice is inefficient and dangerous, requiring the user to remove the blockage by physical force or by pouring hot water over the vent.

One (1) known method for insulating such roof vents is wrapping the vent line with an electrical heat trace tape. This requires the routing of an electrical line to the vent location along with associated electrical power usage, which is difficult and either exposes unsightly and dangerous wires along the roof or requires specialized construction of an available electric source at additional cost and inconvenience.

Various attempts have been made to provide insulating structures for various pipe structures. Examples of these attempts can be seen by reference to several U.S. Patents, including U.S. Pat. No. 2,613,166; U.S. Pat. No. 3,436,880; U.S. Pat. No. 3,797,181; U.S. Pat. No. 4,115,961; U.S. Pat. No. 4,442,643; U.S. Pat. No. 5,245,804; U.S. Pat. No. 5,694,724; and U.S. Pat. No. 6,244,006.

While these devices fulfill their respective, particular objectives, each of these references suffer from one (1) or more of the aforementioned disadvantages. Many such devices are difficult to install. Also, many such devices provide a physical barrier outside of a vent but do not provide significant thermal conductive insulation. Furthermore, many such devices are required to be purchased in a particular size or shape corresponding exactly to an existing vent. Accordingly, there exists a need for an insulated cover for a sewer vent without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a cover for a sewer vent which provides significant thermal insulation and can be utilized with a range of existing sewer vents. Thus, the object of the present invention is to solve the aforementioned disadvantages and provide for this need.

To achieve the above objectives, it is an object of the present invention to include a method for modification of and attachment to an existing sewer roof vent and to prevent freezing of the sewer roof vent after installation. The device comprises a pair of couplers, an inner sleeve, an outer sleeve, and a pair of bushings. The components of the device are preferably constructed of polyvinyl chloride (PVC) or a similar plastic material.

Another object of the present invention is to be available in a kit form, enabling a user to assemble the device during installation over an existing roof vent. The various components of the device are affixed relative to each other utilizing a chemically bonding adhesive.

Yet still another object of the present invention is to utilize the couplings and the bushings to orient the inner sleeve within the outer sleeve with an annular insulating space in between the two (2) sleeves. The annular insulating space is preferably occupied by either air or a fiberglass insulating material and provides significant conductive thermal insulation between the outer sleeve and the inner sleeve.

Yet still another object of the present invention is to coat the exposed outer surface portions of the device with a black plastic-compatible coating media to promote solar heat retention during cold weather conditions and further inhibit freezing within the vent.

Yet still another object of the present invention is to attach over an existing sewer roof vent. The second bushing includes a stop which abuts the existing sewer vent pipe to provide a mechanical fit, while the user can utilize the chemically bonding adhesive to further secure the device in place.

Yet still another object of the present invention is to provide a method of utilizing the device that provides a unique means of obtaining an instance of the device; reaching the location of the sewer vent pipe; measuring the height of the sewer vent pipe above the roof; using a tube cutter to cut-off the excess height of the sewer vent pipe; chemically cleaning the remaining sewer vent pipe with an appropriate solvent; chemically cleaning the corresponding inner portion of the second bushing with the solvent; applying the chemical bonding agent to the cleaned surfaces; installing and pushing the device downward over the prepared sewer vent pipe bottomed against the stop; ascertaining the security of the installation; and prevent freezing of condensation passing through the roof vent due to the insulating and heating properties of the insulating annular space and the darkened exterior of the device.

Further objects and advantages of the present invention will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

| | |
|---|---|
| 10 | insulated sewer vent cover |
| 12 | first coupler |
| 13 | outer sleeve |
| 14 | inner sleeve |
| 15 | stop |
| 16 | first bushing |
| 17 | insulating annular space |
| 18 | second coupler |
| 19 | second bushing |
| 21 | chemically bonded interface |
| 81 | roof flashing |
| 82 | sewer vent pipe |
| 83 | roof |

DETAILED DESCRIPTION OF THE PREFERRED EMBODIMENT

Figure 1:
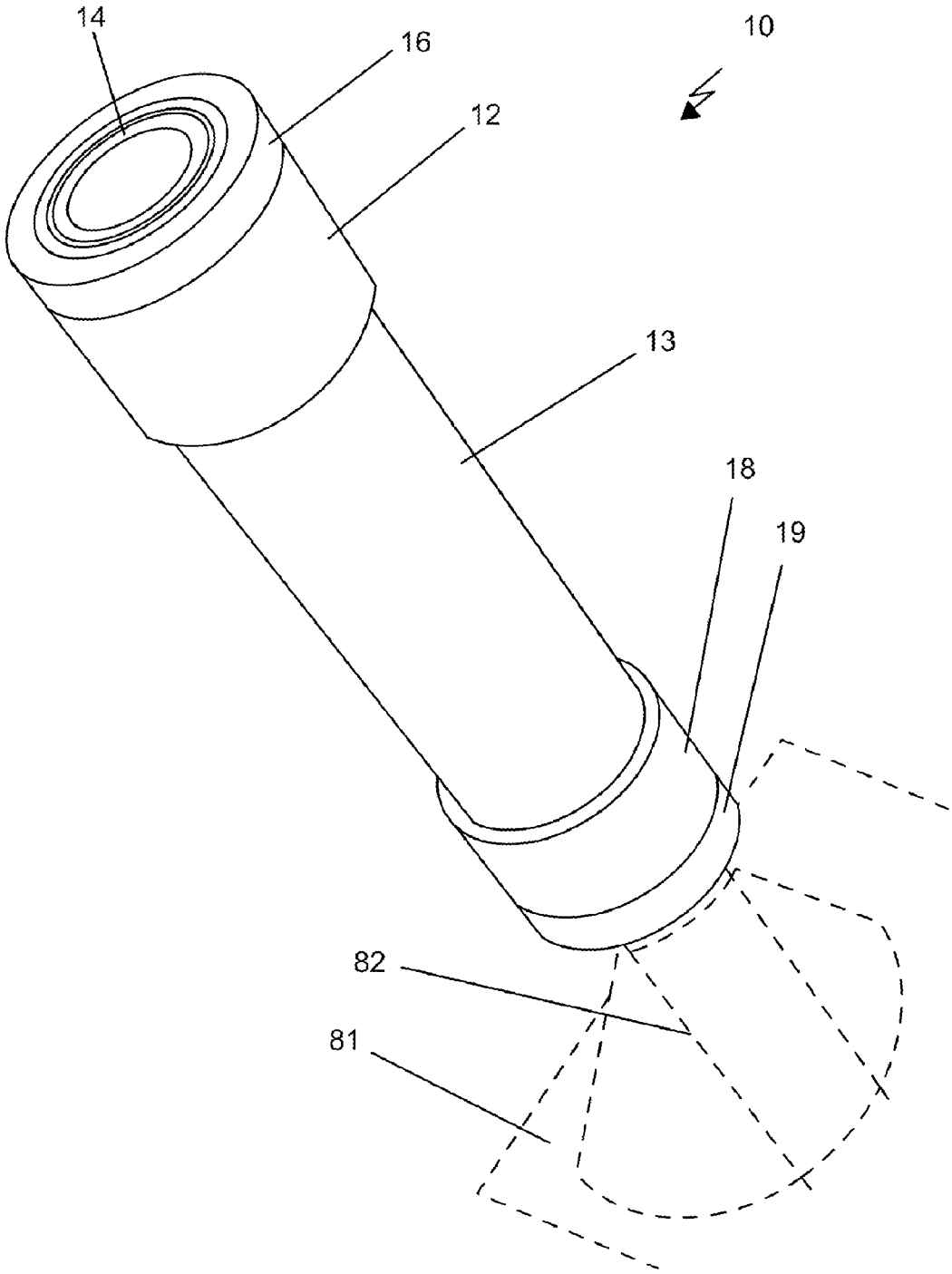
FIG. 1 is a perspective top view of an insulated sewer vent cover 10, according to a preferred embodiment of the present invention; and, FIG. 2 is an orthographic partially cut-away view of the insulated sewer vent cover 10, according to the preferred embodiment of the present invention.
Figure 2:
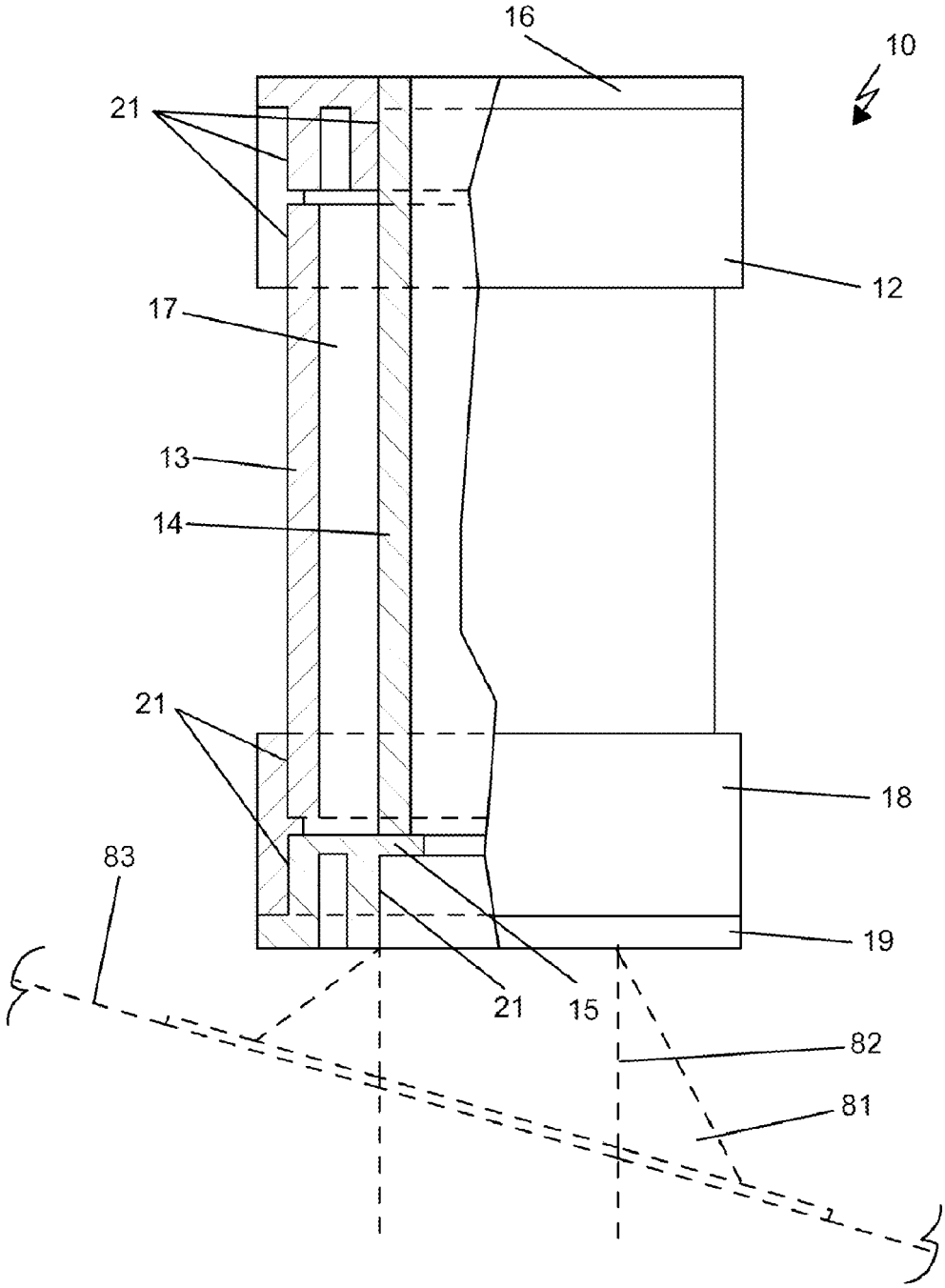

In accordance with the invention, the best mode is presented in terms of a preferred embodiment, herein depicted within FIGS. 1 and 2. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes an insulated sewer vent cover (herein described as the "apparatus") 10, which provides a means for passively eliminating ice blockage on existing roof-mounted sewer vent lines.

Referring now to FIG. 1, a top perspective view of the apparatus 10, according to the preferred embodiment of the present invention, is disclosed. The apparatus 10 is an assembly comprising a first bushing 16, a first coupler 12, a second coupler 18, an outer sleeve 13, an inner sleeve 14, and a second bushing 14. It is envisioned that all members of the apparatus 10 are made of polyvinylchloride (PVC) or similar plumbing-grade plastic material, and that they can be purchased either as regular plumbing components, in the form of a kit, or as a manufactured assembly.

Referring now to FIG. 2, an orthographic partially cut-away view of the apparatus 10, according to the preferred embodiment of the present invention, is disclosed. The apparatus 10 assembly comprises a plurality of chemically bonded interfaces 21, and the second bushing 19 comprising a stop 15, having a lower end intended to limit the correct depth of engagement of the apparatus 10 onto a sewer vent pipe 82. An inner portion of the first bushing 16 comprises a chemically bonded first interface 21 with a corresponding upper outer end portion of the inner sleeve 14. An outer portion of the first bushing 16 comprises a chemically bonded second interface 21 with an inner portion of the first end of a first coupler 12. An inner portion of a second end of the first coupler 12 comprises a chemically bonded third interface 21 with a corresponding upper outer end portion of the outer sleeve 13. A lower outer end portion of the outer sleeve 13 comprises a chemically bonded fourth interface 21 with a first inner portion of a second coupler 18. A second inner portion of the second coupler 18 comprises a chemically bonded fifth interface 21 with a corresponding outer portion of the second bushing 19. The inner portion of the second bushing 19 comprises a chemically bonded sixth interface 21 with a correspondingly cut-off length of an upper end outer portion of the sewer vent pipe 82. A lower outer end portion of the inner sleeve 14 comprises a chemically bonded seventh interface with an upper end of the stop 15 of the second bushing 19. The inner sleeve 14 is in fluid communication with the sewer vent pipe 82 when properly installed. The dimensional difference between the outside diameter of the inner sleeve 14 and the inside diameter of the outer sleeve 13 provides a sealed insulating annular space 17, wherein the desired insulation is provided either by the entrapped air, or by an appropriate insulating material, such as fiberglass, installed during the assembly of the apparatus 10. All exposed outer surface portions of the apparatus 10 are envisioned to be coated with a black plastic-compatible coating media to promote solar heat retention during freezing conditions.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of an assembled apparatus 10, it would be installed as indicated in FIG. 1.

The method of installing the assembled apparatus 10 may be achieved by performing the following steps: procuring ladder; extending the ladder to the height of the roof 83; securing the ladder at the desired location; climbing onto the roof 83; reaching the location of the sewer vent pipe 82; measuring a height of the sewer vent pipe 82 extension above the roof flashing 81; measuring a depth to the stop 15 of the second bushing 19; transferring the depth measurement onto the sewer vent pipe 82 extension; clamping a tube cutter at the depth measurement mark; rotating while progressively tightening the tube cutter to cut-off the excess height of the sewer vent pipe 82; chemically cleaning the outer portion of the remaining sewer vent pipe 82 stub with an appropriate solvent; chemically cleaning the corresponding inner portion of the second bushing 19 with the solvent; applying the chemical bonding agent to the cleaned surfaces; create the sixth chemically bonded interface 21 by installing and pushing the apparatus 10 downward over the prepared sewer vent pipe 82 portion until bottomed against the stop 15; ascertaining the security of the installation of the apparatus 10; descending from the roof 83; returning the ladder to its lowered height; and, cleaning and storing the tools and the ladder.

The method of assembling and installing the apparatus 10 when purchased either in a form of a kit, or in the form of a plurality of regular plumbing components, may be achieve by performing the following additional assembly steps before performing the above described installation steps: chemically cleaning all interface 21 mating surfaces with the appropriate solvent; applying the chemical bonding agent to the inner portion of the first bushing 16 and the corresponding upper end portion of the inner sleeve 14; creating the first chemically bonded interface 21 by pushing the inner sleeve 14 through the inner portion of the first bushing 16 until the upper end portion of the inner sleeve 14 is flush with the outer top surface of the first bushing 16; sequentially creating the plurality of subsequent chemically bonded interfaces 21 by following plumbing standard procedures; cleaning the corresponding interface 21 portions; applying the chemical bonding agent; pushing the corresponding members together until bottomed; and, coating all exposed outer surfaces with a back plastic-compatible medium.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. An insulated sewer vent cover, comprising a multi-sectional assembly having a sealed insulating space therein and adapted to be attached to a sewer vent to prevent freezing of said sewer vent, further including:

an outer sleeve;

an inner sleeve disposed within said outer sleeve;

a first bushing having an inner portion affixed to an upper outer surface of said inner sleeve;

a first coupler, comprising:

a first end having an inner portion affixed to an outer portion of said first bushing; and, a second end having an inner portion affixed to an outer portion of an upper end of said outer sleeve;

a second bushing, having an annular stop disposed within an inner surface thereof, said annular stop comprising an upper end affixed to a lower end of said inner sleeve; and, a second coupler; comprising:

a first end having an inner portion affixed to an outer portion of a lower end of said outer sleeve; and, a second end having an inner portion affixed to an outer portion of said second bushing;

wherein an upper edge of said inner sleeve is coextensive with an upper edge of said first bushing;

wherein said insulating space is defined between said inner sleeve and said outer sleeve:

wherein an upper end of said sewer vent abuts against said stop;

wherein an inner portion of said second bushing is affixed to said sewer vent upper end; and, wherein said inner sleeve is in fluid communication with said sewer vent when installed thereon;

wherein said sewer vent cover further comprises a resilient and waterproof material; and, wherein said multi-sectional assembly comprises a plurality of components affixed to each other, thereby sealing said insulating space from an external environment.

2. The cover of claim 1, wherein said components are affixed to each other with a chemical bonding agent.

3. The cover of claim 2, wherein said insulating space is further filled with an entrapped air.

4. The cover of claim 3, further comprising a black coating media bonded to all external surfaces of said cover;

wherein said media promotes solar heat retention.

5. The cover of claim 4, wherein said resilient and waterproof material further comprising polyvinyl chloride (PVC).

6. The cover of claim 1, wherein said components are affixed to each other with a chemical bonding agent.

7. The cover of claim 6, wherein said insulating space is filled with an insulating material.

8. The cover of claim 7, wherein said insulating material is fiberglass.

9. The cover of claim 8, further comprising a black coating media bonded to all external surfaces of said cover;

wherein said media promotes solar heat retention.

10. The cover of claim 9, wherein said resilient and waterproof material further comprising polyvinyl chloride (PVC).

11. A method of preventing freezing of a roof-mounted sewer vent pipe with an insulating sewer vent cover comprises the following steps:

providing said sewer vent cover, further comprising:

an outer sleeve;

an inner sleeve disposed within said outer sleeve;

an annular insulating space defined between said inner sleeve and said outer sleeve;

a first bushing having an inner portion affixed to an upper outer surface of said inner sleeve with a chemical bonding agent;

a first coupler, comprising a first end having an inner portion affixed to an outer portion of said first bushing with said chemical bonding agent, and a second end having an inner portion affixed to an outer portion of an upper end of said outer sleeve with said chemical bonding agent;

a second bushing, having an annular stop disposed within an inner surface thereof, said annular stop comprising an upper end affixed to a lower end of said inner sleeve said chemical bonding agent, such that insulated space is sealed from an external environment; and, a second coupler; comprising a first end having an inner portion affixed to an outer portion of a lower end of said outer sleeve said chemical bonding agent, and a second end having an inner portion affixed to an outer portion of said second bushing said chemical bonding agent;

wherein all external surfaces of said sewer vent cover comprises a black coating media;

applying said chemical bonding agent to an upper edge of said sewer vent pipe; and, installing said sewer vent cover on said sewer vent pipe by abutting said stop within said second bushing against an upper edge sewer vent pipe, such that said inner sleeve is in fluid communication with said sewer vent pipe.

12. The method of claim 11, further comprising the following steps prior to said installing step:

cleaning an external surface of said sewer vent pipe; and, cleaning an internal surface of said second bushing.

13. A method of producing an insulated sewer vent cover comprising the following steps:

providing an inner sleeve;

providing a first bushing;

bonding an outer surface of an upper end of said inner sleeve to an inner surface of a first bushing;

providing a second bushing;

bonding an outer surface of a lower end of said inner sleeve to an upper end of an annular stop disposed about an inner surface of said second bushing;

providing an outer sleeve;

bonding an inner surface of a lower end of said outer sleeve to an outer surface of said second bushing and bonding an inner surface of an upper end of said outer sleeve to an outer surface of said second bushing, thereby producing a sealed insulated space between said inner sleeve and said outer sleeve;

providing a first coupler;

bonding an inner surface of a first end of said first coupler to an outer surface of said first bushing and bonding an inner surface of a second end of said first coupler to an outer surface of said upper end of said outer sleeve;

providing a second coupler; and, bonding an inner surface of a first end of said second coupler to an outer surface of said lower end of said outer sleeve and bonding an inner surface of a second end of said second coupler to an outer surface of said second bushing.

14. The method of claim 13, further comprising the step of:

coating all external surfaces of said sewer vent cover with a black coating media.

15. The method of claim 13, wherein said bonding steps are accomplished with a chemical bonding agent.

16. The method of claim 15, further comprising the step of:

coating all external surfaces of said sewer vent cover with a black coating media.

* * * * *